United States Patent [19]

Davies et al.

[11] 4,301,819

[45] Nov. 24, 1981

[54] APPARATUS FOR PREVENTION OF MATERIAL BUILD-UP SUCH AS TOBACCO IN A CONDUIT

[75] Inventors: Ken W. Davies, Lagos, Nigeria; Don J. Disch, Charlestown, Ind.

[73] Assignee: Brown & Williamson Tobacco Corporation, Louisville, Ky.

[21] Appl. No.: 139,535

[22] Filed: Apr. 11, 1980

[51] Int. Cl.[3] ..... A24B 3/12; A24B 3/18

[52] U.S. Cl. ..... 131/302; 131/303; 131/304; 55/80; 55/269

[58] Field of Search ..... 131/133–138, 131/140 R, 300–306; 406/48, 193, 168; 137/340; 118/239; 62/62, 64; 165/134 DP, 169; 55/80, 269

*Primary Examiner*—V. Millin

*Attorney, Agent, or Firm*—Charles G. Lamb

[57] ABSTRACT

An apparatus and method for preventing the build-up of undesirable materials such as tobacco in a bend in a conduit containing a gas stream having water vapor therein.

6 Claims, 2 Drawing Figures

APPARATUS FOR PREVENTION OF MATERIAL BUILD-UP SUCH AS TOBACCO IN A CONDUIT

BACKGROUND OF THE INVENTION

1. Field of the Invention

The invention relates to an apparatus for drying material and more particularly relates to an apparatus and method for preventing the build-up of undesirable materials in the apparatus under relatively high humidity drying conditions.

2. Brief Description of the Prior Art

In the drying of material in a flowing gas stream in a continuous operation, if the gas stream includes solids or highly viscous materials therein, there is a tendency for these materials to deposit and build up in areas of the equipment where velocity is substantially reduced. This settling or build-up generally occurs where relatively sharp turns are experienced in the gas flow through the drying equipment.

For example, in the drying of tobacco, tobacco generally enters drying equipment relatively high in moisture and includes flavorings and the like, commonly referred to in the tobacco industry as "casings," in the gas stream which is processed in the drying equipment. During drying, build-up occurs in the equipment, particularly at points where the particle velocity is substantially reduced.

In the drying of cut tobacco, the initial moisture content usually ranges from about 15 to 35 percent for the lamina, and from about 20 to 60 percent for the stem. This tobacco is dried in the presence, generally, of hot air until the moisture is in the range of from about 12 to 15 percent. Several devices are known in the prior art and two examples of drying cut tobacco are disclosed in U.S. Pat. No. 3,357,436 and U.S. Pat. No. 4,167,191.

In recent years, it has become a widespread practice in the tobacco industry to expand or "puff" tobacco prior to incorporation into a cigarette product. This expansion or "puffing" leads to better economics as well as a lowering of the tar and nicotine in the final product. Many different techniques are described and known in the prior art for expanding tobacco, such as impregnation of the tobacco with water, an organic liquid, carbon dioxide, or ammonia, and then subjecting the impregnated tobacco to temperatures or pressures sufficient to then liberate the impregnant from the tobacco. However, in many of the drying techniques utilized for expanding the tobacco, many of the advantages attributed to the expansion technique are lost because of the shrinking during the drying process. Furthermore, in the drying of the tobacco at relatively high humidity there is a tendency for the viscous casings to settle out and plug up the drying equipment. Thus, an apparatus which eliminates the problem or at least reduces the problem of build-up is of substantial benefit in the processing of expanded tobacco particles.

SUMMARY OF THE INVENTION

In the present invention, it is recognized that it is desirable to provide an improved apparatus for the prevention of particulate build-up in gas streams of relatively high temperatures. Furthermore, it is recognized that it is desirable to provide an apparatus which prevents the build-up of particulates in a system for drying of expanded tobacco. Even further, it is recognized that it is desirable to provide an apparatus for prevention of build-up of particulates in a system for drying tobacco at a temperature above 250° F. in the presence of an absolute humidity at a level above that which will provide a wet-bulb temperature of at least above 150° F., this condition being referred to as under "high humidity conditions."

Various other features of the present invention will become obvious to those skilled in the art of reading the disclosures set forth hereinafter.

More particularly, the present invention provides in an apparatus for conveying tobacco in a gas stream having water vapor therein, the apparatus having a conduit with at least one turn of greater than 45° therein and means to convey tobacco through the conduit in the gas stream, the improvement comprising: means to cool the inner surface of the at least one turn to a temperature equal to or less than the temperature to condense water vapor in the gas stream.

Even more particularly, the present invention provides a method for preventing the build-up of undesirable materials in a bend in a conduit containing a gas stream having water vapor therein which comprises: cooling the interior surface of the bend to a temperature below the condensing point of the water vapor.

It is to be understood that the description of the examples of the present invention given hereinafter are not by way of limitation and various modifications within the scope of the present invention will occur to those skilled in the art upon reading the disclosure set forth hereinafter.

DETAILED DESCRIPTION OF THE INVENTION

Figure 1:
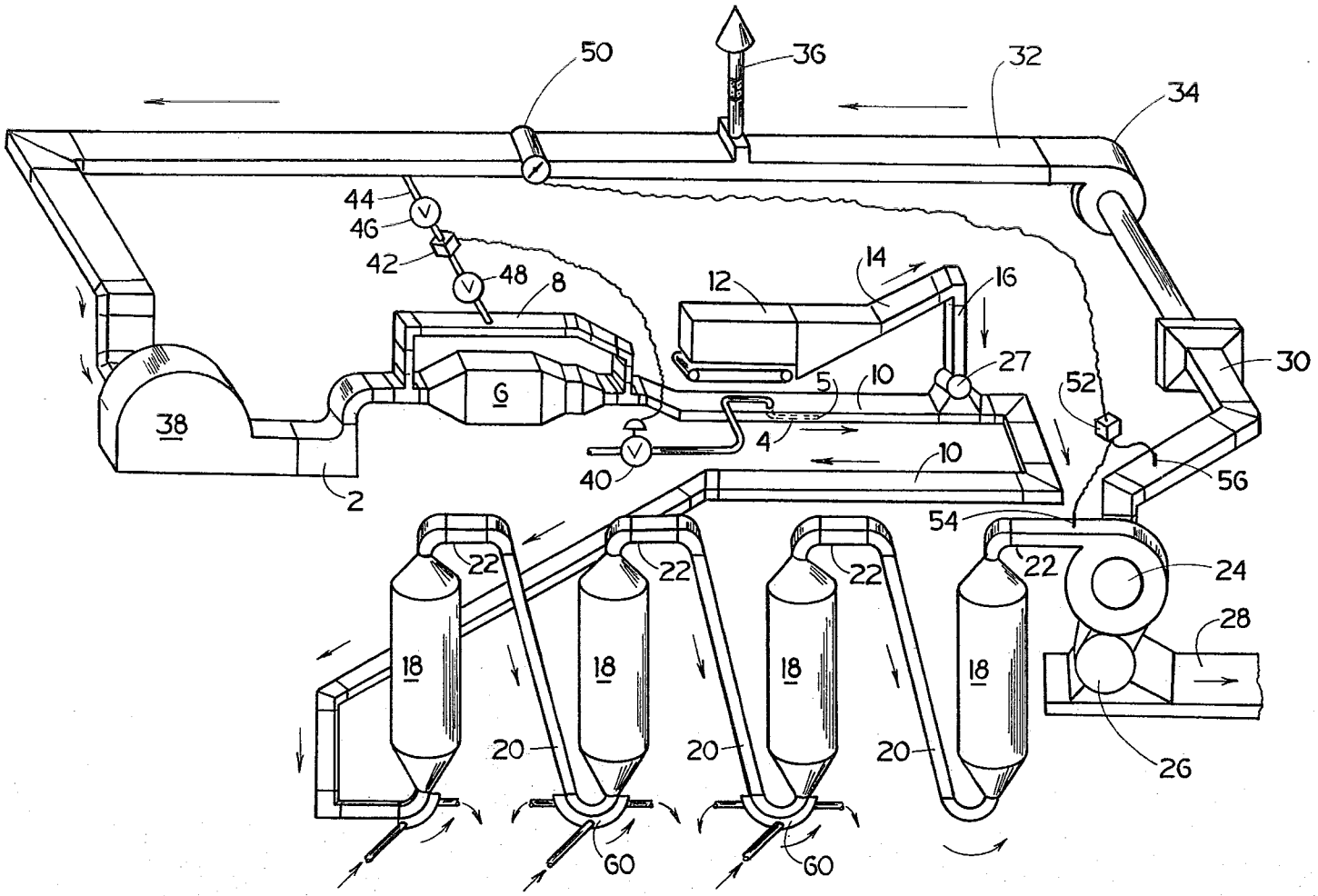
FIG. 1 is a schematic flow diagram using a preferred apparatus of the invention; and, FIG. 2 is a perspective view, with selected portions cut-away, of one preferred apparatus of the present invention.
Figure 2:
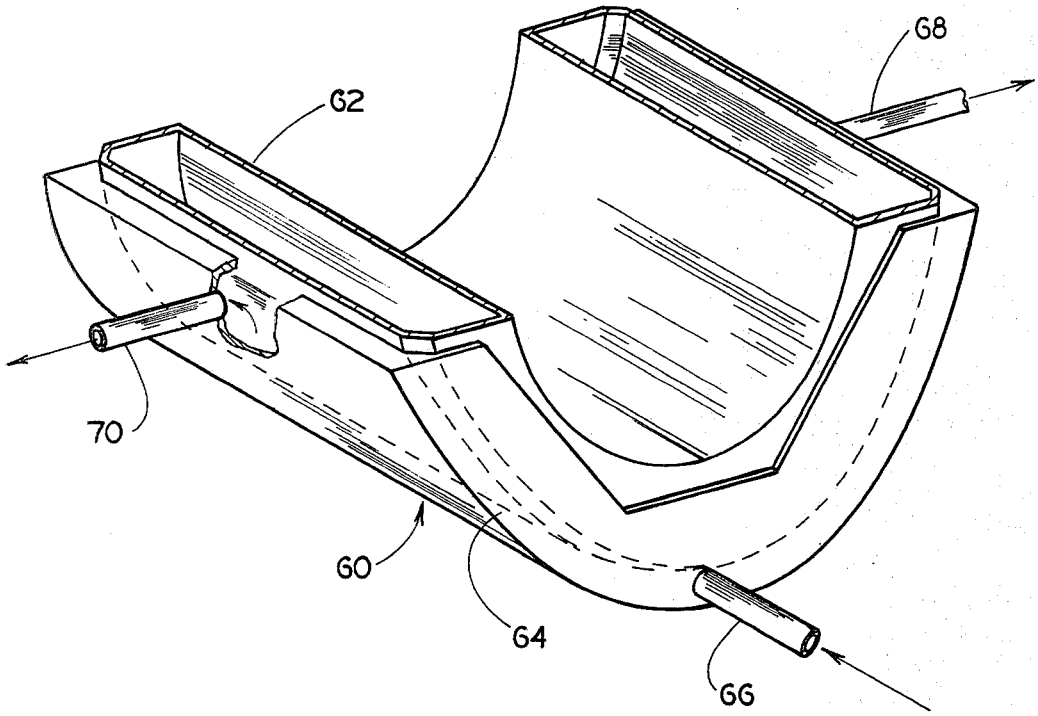

Referring to FIG. 1 in carrying out the present invention, air is carried by closed duct 2 through a closed heater 6 and the exiting heated air flows into conduit 10. A heater by-pass duct 8 may be automatically or manually valved to by-pass air around the heater 6, providing a means of regulating the temperature of the air entering conduit 10. The capacity of heater 6 and the design of by-pass duct 8 is advantageously such that the temperature of air in conduit 10 is maintained within a preselected temperature range generally above 250° F. The air carried by or through conduit 10 passes steam entry port 4, through which steam or a mixture of steam and air may be injected into the air stream. The steam injection port 4, which includes a nozzle 5 at the terminating end thereof, injects steam into the air stream at an angle of less than 45° of the direction of flow of the air. As shown in FIG. 1, the steam enters the air stream substantially parallel to the flow of the air. The steam introduced through entry port 4 is advantageously adjusted by automatic control of steam control valve 40 to maintain a relatively high pre-selected humidity in the conduit 10. Steam control valve 40 is operated in response to the wet-bulb temperature of the air flowing in conduit 32, a wet-bulb sensing device being noted by the numeral 42. The wet-bulb sensing device is disposed in sample line 44 which is connected between conduit 32 and heater by-pass duct 8. A pair of valves 46 and 48 are disposed on opposite sides of wet-bulb sensing device 42 to shut off the flow of air therethrough for on line calibration and maintenance.

Expanded tobacco is conveyed from supply hopper 12 by supply conveyer 14 to vertical pipe 16 into air lock 27 then into conduit 10. Other times the tobacco supply means may, of course, be used to bring expanded tobacco into the intimate admixture with the hot, high humidity air within conduit 10. The air entrained expanded tobacco is then carried through a plurality of drying chambers 18 and connecting ducts 20.

At the entrance to the chambers 18, an elbow assembly 60 is provided to connect chambers 18 with either conduits 10 or connecting ducts 20. The elbow assembly 60 includes an inner hollow substantially "U" shaped member 62 enclosed by an outer housing 64 having outer walls spaced from the member 62. Housing 64 is provided with one inlet 66 in flow communication with a water supply source (not shown) and two outlets 68 and 70, in flow communication with a reservoir or other means for receiving the water exiting from housing 64. It is realized that assembly 60 is shown as being substantially "U" shaped, but other shapes or bends may be utilized without departing from the scope and spirit of the invention.

The hollow member 62 is in flow communication with the chamber 18 and the conduit 10 or duct 20 wherein the air entrained tobacco flows therethrough. Water is kept in the housing 64 so that the temperature of the inner surface of member 62 is kept below a preselected temperature, this temperature being below the condensing temperature for the water vapor in the air stream. Thus, in operation, where the air entrained tobacco also includes casings therein, the water vapor will have a tendency to condense and lower the resistance to sticking of the viscous materials when they impinge upon the inner surface of member 62 as it flows therethrough.

It is realized that means to control the flow of water and simultaneously therewith the temperature of the inner surface 62 are not shown. However, any means known in the art may be used as the criticality of control is not important, the only criteria necessary is that the inner surface of member 62 is relatively "cold" in relation to the gas stream flowing therethrough so that some of the water vapor in the gas stream will condense and keep the inner surface wet.

The chambers 18 are a dryer means, to effect drying of the air entrained expanded tobacco to the desired moisture level. The chambers 18 may be selected to have a capacity sufficient to maintain the desired temperature range of the airflow, usually from about 250° F. to about 650° F. The number of chambers 18 may be selected to provide any desired residence time for any degree of drying desired.

Expanded tobacco and air exiting from the last chamber 18 is carried through duct 22 to a separator 24. The separator 24 is preferably a tangential separator. It will be appreciated, however, that other types of separators may be used. Tobacco exits from separator 24 through airlock 26 and is conveyed to the next tobacco processing stage by conveyor 28. The separated exhaust air is recycled through ducts 30 and 32. A fan 34 is interposed within the ductwork to motivate the air. Also, an exhaust port 36 is positioned in the duct 32 to exhaust excess air from the system. Air carried through duct 32 re-enters duct 2 through a final separator 38, which removes any dust from the airstream. Preferably, separator 38 is a rotoclone type of separator, which also assists in motivating the air. In FIG. 1, the arrows show the flow direction of the expanded tobacco and/or air. Inasmuch as the amount of moisture removed from a particular tobacco, types of tobacco, blends of tobacco and form thereof will vary, the operating parameters of the process of the invention will vary, accordingly, in producing a uniform and constant moisture content of tobacco discharged from the system.

In order to control the flow through the system, a damper 50 is provided in the recycle conduit 32. Damper 50 is operated in response to the pre-selected pressure of pressure sensing device 52 which includes a pair of pressure sensing probes 54 and 56 which are disposed in the air stream, on opposite sides of tobacco separator 24. Each probe measures the pressure of the air stream at the preselected position and the differential pressure as received by the pressure sensing device 52 determines the opening or closing position of the damper 50.

The quantity of heat required for drying the tobacco will be dependent upon the rate at which the tobacco is fed through the system and upon its initial moisture content. An increase in either the said rate or content will tend to produce a reduction of air temperature in the conduit 10 and chambers 18, so that the heat input in heater 6 will of necessity have to be increased. Similarly, a reduction in feed rate or moisture content will produce a reduction in the heat input. Accordingly, the heat input will be so proportioned, depending upon the conditions, that the final moisture content of the tobacco will be maintained constant.

In operation, inlet air temperature entering conduit 10 will generally range from between 250° F. and 650° F. with the expanded tobacco temperature ranging up to 215° F. The expanded tobacco containing casings and a relatively high percentage of moisture passes through elbow assembly 60 as it enters chamber 18. The casings have a tendency to "stick" to bends in the flow system, such as elbow assemblies 60, and entrap other particulates. However, by maintaining the inner surface of hollow member 62 relatively cold, some of the water vapor will condense upon striking the surface thereby making the inner surface wet, lowering the coefficient of friction thereof. Thus, by lowering the coefficient of friction of the inner surface of member 62, when the casings and tobacco strike the inner surface, tendency to "stick" is substantially reduced.

It will be realized that various changes may be made to the specific embodiment shown without departing from the scope and spirit of the present invention.

What is claimed is:

1. A method for preventing the buildup of tobacco in a bend in a conduit containing a gas stream having water vapor therein which comprises: passing tobacco materials in a gas stream having water vapor therein through the bend in a conduit; and, cooling the interior surface of the bend to a temperature below the condensing point of the water vapor.

2. In an apparatus for conveying tobacco at high humidity in a gas stream, the apparatus having a conduit with at least one turn of greater than 45° therein and means to convey tobacco through said conduit in said gas stream, the improvement comprising: means to cool the inner surface of the at least one turn to a temperature equal to or less than the temperature to condense water vapor in said gas stream.

3. In the apparatus of claim 2, said means to cool including a housing enclosing said turn with an inlet therein in flow communication with a water supply source and an outlet to flow communication with means to remove water from said housing.

4. In the apparatus of claim 2, said turn being an elbow assembly.

5. An apparatus for conveying material in a gas stream containing water vapor comprising: a conduit system having at least one inlet to receive material including water vapor therein and at least one outlet to discharge material therefrom, the conduit system having at least one bend therein; means to convey said material through said conduit system; and, means to maintain said at least one bend at a temperature lower than the temperature to condense said water vapor.

6. The apparatus of claim 5 wherein said bend is enclosed within a housing having an inlet in flow communication with a water supply source and an outlet in flow communication with means to remove water from said housing.

* * * * *